US008894324B2

(12) United States Patent
Cucchiara

(10) Patent No.: US 8,894,324 B2
(45) Date of Patent: Nov. 25, 2014

(54) DRAINAGE SYSTEM, APPARATUS, AND METHOD

(75) Inventor: Christopher Charles Cucchiara, Statesville, NC (US)

(73) Assignee: ABT, Inc., Troutman, NC (US)

( * ) Notice: Subject to any disclaimer, the term of this patent is extended or adjusted under 35 U.S.C. 154(b) by 690 days.

(21) Appl. No.: 12/935,858

(22) PCT Filed: Mar. 31, 2009

(86) PCT No.: PCT/US2009/039037

§ 371 (c)(1), (2), (4) Date: Jan. 6, 2011

(87) PCT Pub. No.: WO2009/146046

PCT Pub. Date: Dec. 3, 2009

(65) Prior Publication Data

US 2011/0091281 A1 Apr. 21, 2011

Related U.S. Application Data

(60) Provisional application No. 61/041,008, filed on Mar. 31, 2008.

(51) Int. Cl.

| | |
|---|---|
| ***E01F 5/00*** | (2006.01) |
| ***E02B 13/00*** | (2006.01) |
| ***E01C 13/00*** | (2006.01) |
| ***E03F 3/04*** | (2006.01) |

(52) U.S. Cl.

CPC ..... *E03F 3/046* (2013.01); *E01C 13/00* (2013.01)

USPC ..... 405/43; 405/118; 404/4

(58) Field of Classification Search

USPC ..... 405/43, 47, 48, 118; 404/2, 4

See application file for complete search history.

(56) References Cited

U.S. PATENT DOCUMENTS

| | | | | |
|---|---|---|---|---|
| 1,659,307 | A * | 2/1928 | Wittman | 210/163 |
| 5,647,689 | A * | 7/1997 | Gunter | 405/36 |
| 5,653,553 | A | 8/1997 | Gunter | |
| 2004/0136785 | A1 | 7/2004 | Gunter | |

FOREIGN PATENT DOCUMENTS

| | | | |
|---|---|---|---|
| DE | 8714240 | U1 | 12/1987 |
| DE | 10343367 | A1 | 6/2004 |
| EP | 0798418 | A1 | 10/1997 |
| EP | 1865117 | A1 | 12/2007 |
| JP | 3244702 | | 10/1991 |
| JP | 03244702 | A * | 10/1991 |
| JP | 2004-316167 | | 11/2004 |
| JP | 2004-316167 | A | 11/2004 |
| KR | 20-0419504 | Y1 | 6/2006 |

OTHER PUBLICATIONS

IPRP for PCT/US2009/039037 mailed Oct. 14, 2010.

(Continued)

*Primary Examiner* — Benjamin Fiorello

(74) *Attorney, Agent, or Firm* — Moore & Van Allen PLLC; Henry B. Ward, III

(57) ABSTRACT

Embodiments of the invention provide a drainage system for draining surface liquids from a first surface adjacent to one side of a drainage channel and for providing a transition from the first surface on one side of the drainage channel to a synthetic turf surface or other thick surface material on the other side of the drainage channel.

17 Claims, 6 Drawing Sheets

(56) References Cited

OTHER PUBLICATIONS

European Patent Office; Extended European Search Report; Feb. 29, 2012; issued in European Patent Application 09755409.

International Search Report for PCT/US2009/039037 dated Mar. 31, 2009.

European Patent Office; Communication Pursuant to Article 94(3) EPC; Jan. 24, 2013; issued in European Patent Application No. 09 755 409.1.

* cited by examiner

DRAINAGE SYSTEM, APPARATUS, AND METHOD

FIELD

The invention generally relates to the field of drainage systems, and more particularly, embodiments of the invention relate to systems and methods for providing drainage and a synthetic turf anchoring location at the edge of a synthetic turf surface.

BACKGROUND

Drainage and other trenches of various sizes and shapes are desirable for a number of applications. For example, manufacturing facilities typically require drainage systems that include trenches formed in the building floors to collect, remove, and/or recycle excess water or other liquids. In addition, numerous outdoor industrial and commercial sites, such as parking lots, require drainage systems, including trenches, to collect and direct rainwater and other liquids to underground storm sewers to prevent flooding and to decrease run-off. Similarly, roadways and the like may also require drainage systems, including trenches.

Drainage systems are also desirable around athletic facilities such as running tracks, tennis courts, pool decks, and the like. Drainage is also often desirable around natural and synthetic turf surfaces. Furthermore, such natural and synthetic turf surfaces may be adjacent to other surfaces that also require drainage and, therefore, the turf may end at the drains that surround these other surfaces.

For example, many athletic facilities feature a track surrounding a football and/or soccer field where the field is made up of synthetic turf. The track surface may require a drainage system adjacent to the inside edge of the track, between the track and the football/soccer field. Since the top of the drainage channel is usually flush with or slightly lower than the track surface that it is designed to drain, it is generally desirable for aesthetic purposes and to prevent a trip hazard, to sink the bottom of the turf surface relative to the top of the drainage channel so that the surfaces on either side of the drainage channel are generally flush with each other. It is also often necessary to anchor the edge of the synthetic turf. Currently, a piece of wood is positioned in the ground next to the drainage channel and, in some cases, attached to the exterior surface of the concrete that is surrounding the drainage channel at some location lower than the upper edge of the concrete. The wood board extends away from the concrete under the synthetic turf and provides a surface to which the synthetic turf can be nailed. Alternatively, a concrete ledge is sometimes formed below the top edge of the drainage channel leaving the top of the drainage channel exposed and without supporting concrete. These procedures, however, add extra time and expense to the installation process and may weaken the drainage channel structure and limit the design of the drainage channel. Also, over time the wood surface may warp and decompose thereby providing a poor anchor for the synthetic turf surface.

Therefore, the inventors of the present application have identified a need to provide an improved system for integrating a drainage system between two different surfaces, particularly where one of the surfaces is a synthetic turf surface or some other surface that is thicker than the surface on the opposite side of the drainage channel. The inventors have also identified a need to provide improved systems for anchoring the edges of a synthetic turf surface and for integrating a drainage system with a synthetic turf anchor location and turf edge.

BRIEF SUMMARY OF EMBODIMENTS OF THE INVENTION

To solve these problems and/or other problems, embodiments of the present invention provide a drainage apparatus for providing a transition from a first surface to a second surface. In one embodiment, the apparatus comprises a drainage channel positioned between the first surface and the second surface, and a grate for covering the drainage channel. In another embodiment, the grate comprises one or more openings structured to allow a liquid to pass therethrough and into the drainage channel. In a further embodiment, the grate comprises a first portion and a second portion, the grate being structured so that the first portion of the grate is positioned at a first level substantially flush with the first surface, and so that the second portion of the grate is positioned at a second level substantially flush with the second surface, and where the second level is displaced vertically from and lower than the first level.

In one embodiment, the drainage channel comprises first and second sidewalls, and the grate comprises a first lip extending downward from the first portion of the grate, the first lip being disposed adjacent to at least a portion of the first sidewall of the drainage channel. In another embodiment, the grate further comprises a second lip extending downward from the second portion of the grate, the second lip being disposed adjacent to at least a portion of the second sidewall of the drainage channel.

In one embodiment, the second surface comprises a base having a synthetic turf surface. In another embodiment, the first surface comprises a rubberized running track surface. In still another embodiment, at least a portion of the grate is secured to a portion of the drainage channel.

In one embodiment, the drainage channel comprises first and second sidewalls separated by an opening, where the length of the first sidewall is substantially the same length as the length of the second sidewall. In another embodiment, the first portion of the grate is secured to the first sidewall of the drainage channel and the second portion of the grate is secured to the second sidewall of the drainage channel. In still another embodiment, the first portion of the grate and the first sidewall of the drainage channel define a first gap between the first portion of the grate and the first sidewall of the drainage channel. In yet another embodiment, the second portion of the grate and the second sidewall of the drainage channel define a second gap between the second portion of the grate and the second sidewall of the drainage channel.

In one embodiment, at least a portion of the grate is secured to at least a portion of the second surface. In another embodiment, the first portion of the grate further comprises one or more openings therethrough structured to allow a liquid flowing from the first surface to pass therethrough. In another embodiment, the second portion of the grate further comprises one or more openings therethrough structured to allow a liquid flowing from the second surface to pass therethrough. In still another embodiment, the grate further comprises a generally vertical third portion joining the first and second portions.

In one embodiment, a juncture between the second portion and the third portion comprises one or more openings therethrough structured to allow a liquid flowing from the second surface to pass therethrough. In another embodiment, the drainage channel comprises first and second sidewalls separated by an opening, where the length of the first sidewall is greater than the length of the second sidewall, and where the first sidewall is structured to support the first portion of the grate and the second sidewall is structured to support the second portion of the grate.

Embodiments of the invention also provide a drainage apparatus comprising a drainage channel comprising a first sidewall and a second sidewall separated by an opening, where the length of the first sidewall is greater than the length of the second sidewall. In one embodiment, the apparatus further comprises a grate structured to extend across the drainage channel from the first sidewall to the second sidewall. In another embodiment, the grate comprises a substantially horizontal first portion extending from the first sidewall over at least a portion of the opening between the first sidewall and the second sidewall. In another embodiment, the grate comprises a substantially horizontal second portion extending from the second sidewall over at least a portion of the opening between the first sidewall and the second sidewall. In still another embodiment, the grate further comprises a substantially vertical third portion extending between the first and second portions over at least a portion of the opening between the first sidewall and the second sidewall.

In one embodiment, the grate comprises a first lip extending downward from the first portion of the grate, the first lip being disposed adjacent to at least a portion of the first sidewall of the drainage channel. In another embodiment, the grate further comprises a second lip extending downward from the second portion of the grate, the second lip being disposed adjacent to at least a portion of the second sidewall of the drainage channel.

In one embodiment, at least one of a portion of the grate is secured to a portion of the drainage channel. In another embodiment, the first portion of the grate further comprises one or more openings therethrough structured to allow a liquid to flow therethrough. In still another embodiment, the second portion of the grate further comprises one or more openings therethrough structured to allow a liquid to flow therethrough. In another embodiment, a juncture between the second portion of the grate and the third portion of the grate comprises one or more openings therethrough structured to allow a liquid to flow therethrough.

Embodiments of the invention also provide for a drainage grate for covering an opening in a drainage channel. In one embodiment, the drainage gate comprises a generally horizontal first portion having a first end and a second end, a generally horizontal second portion having a first end and a second end, and a generally vertical third portion extending from the second end of the first portion to the first end of the second portion. In another embodiment, the grate is structured so that, when the grate is installed over the opening in the drainage channel, the first end of the first portion of the grate is adjacent to one side of the drainage channel and the second end of the second portion of the grate is adjacent to a second side of the drainage channel. In another embodiment, the first portion of the grate is structured to be offset vertically from and elevated higher than the second portion of the grate when the grate is installed over the opening in the drainage channel.

Embodiments of the invention further provide for a method for installing a drainage apparatus between two vertically displaced surfaces. In one embodiment, the method comprises providing a drainage channel and providing a grate structured to extend across the drainage channel. In one embodiment, the grate comprises a first portion located at a first level corresponding to a first vertically displaced surface, a second portion located at a second level corresponding to a second vertically displaced surface, and a third portion located generally vertically between the first and second portions. In another embodiment, at least one of the first, second, and third portions defines at least one opening therein for permitting liquid to pass therethrough into the drainage channel. In still another embodiment, the method further comprises placing the grate across the drainage channel. In yet another embodiment, the method further comprises placing synthetic turf on the first portion of the grate.

BRIEF DESCRIPTION OF THE SEVERAL VIEWS OF THE DRAWINGS

Figure 1:
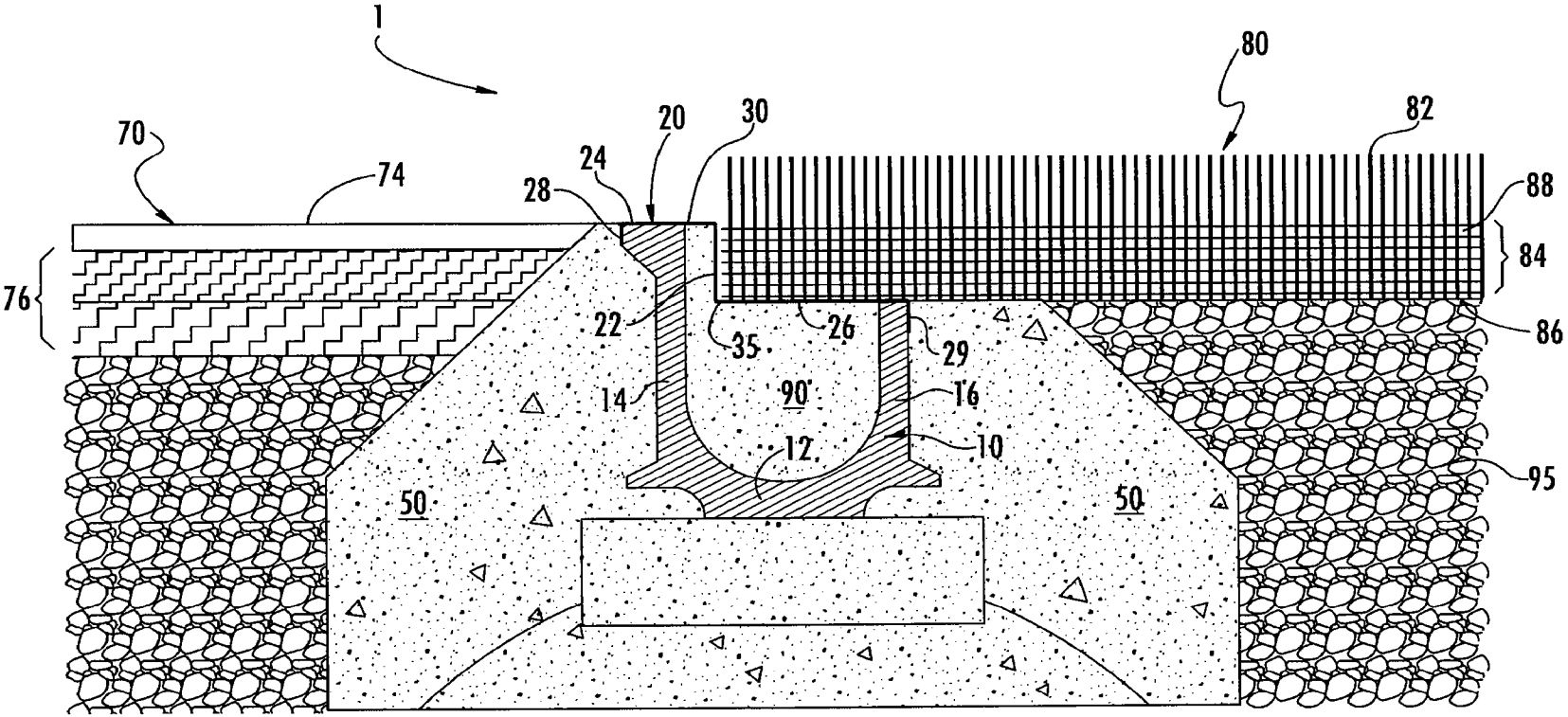
Figure 2A:
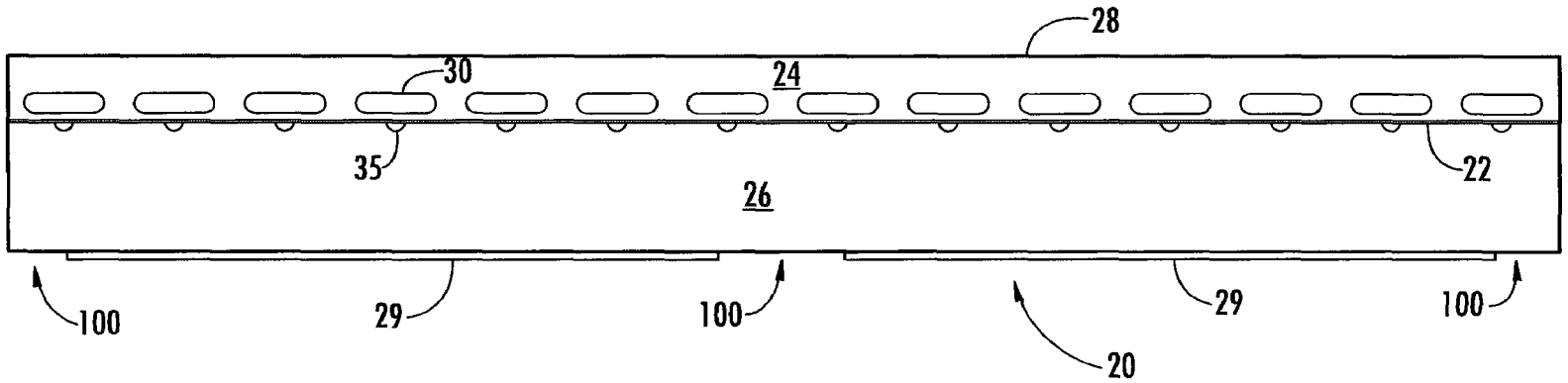
Figure 2B:
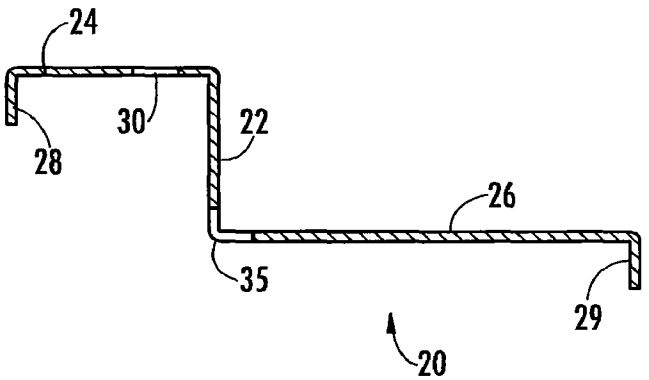
Figure 3:
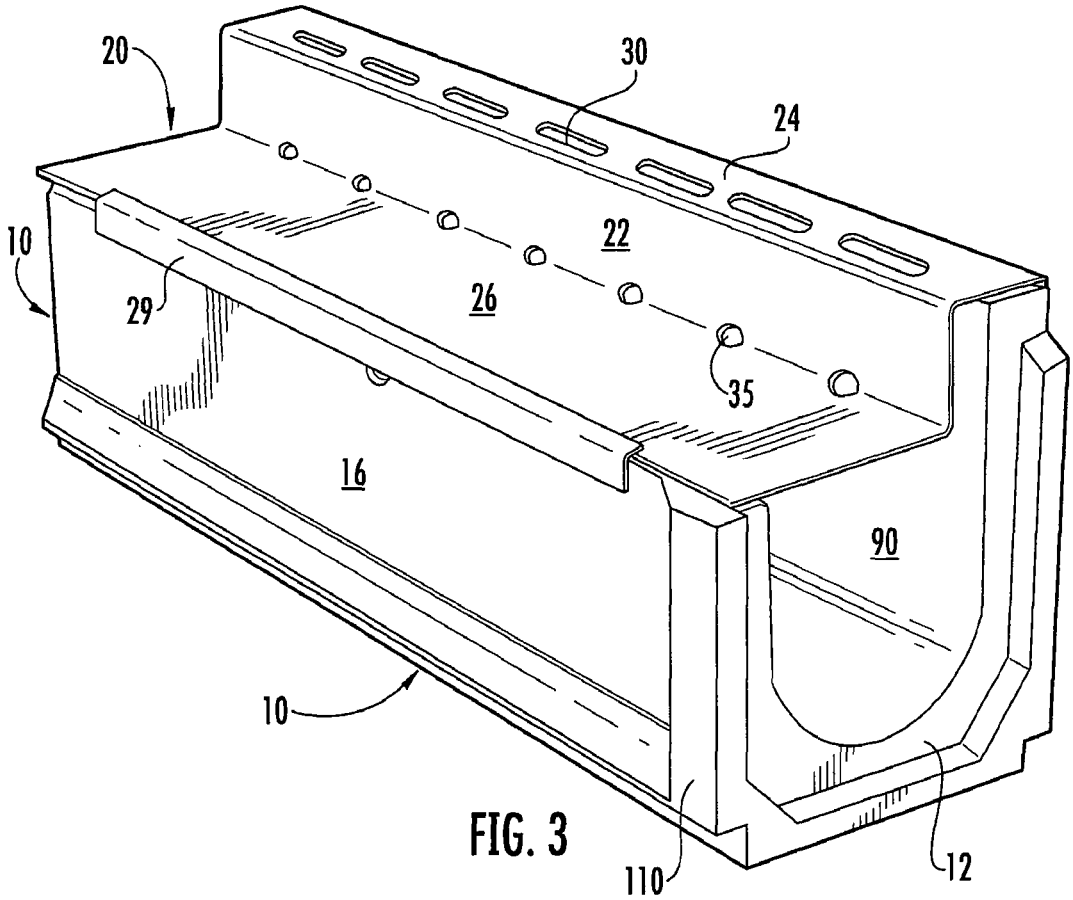
Figure 4:
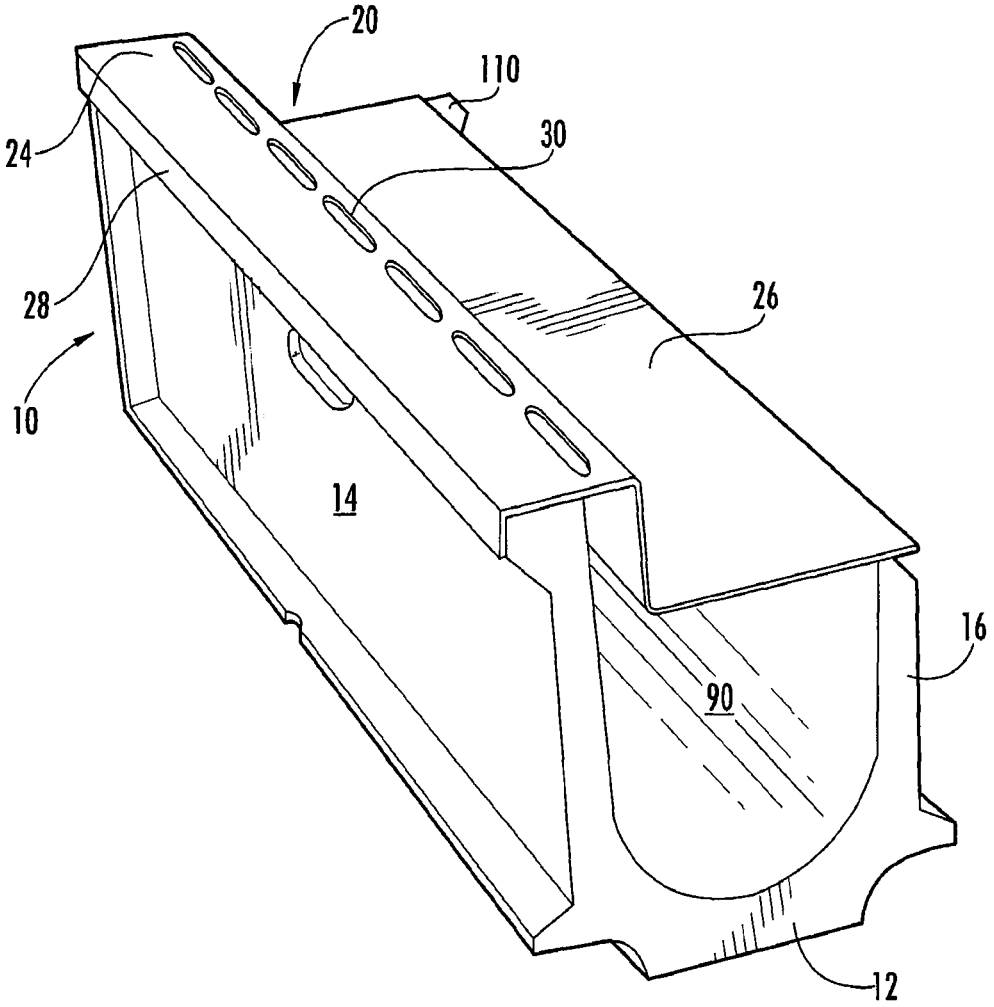
Figure 5:
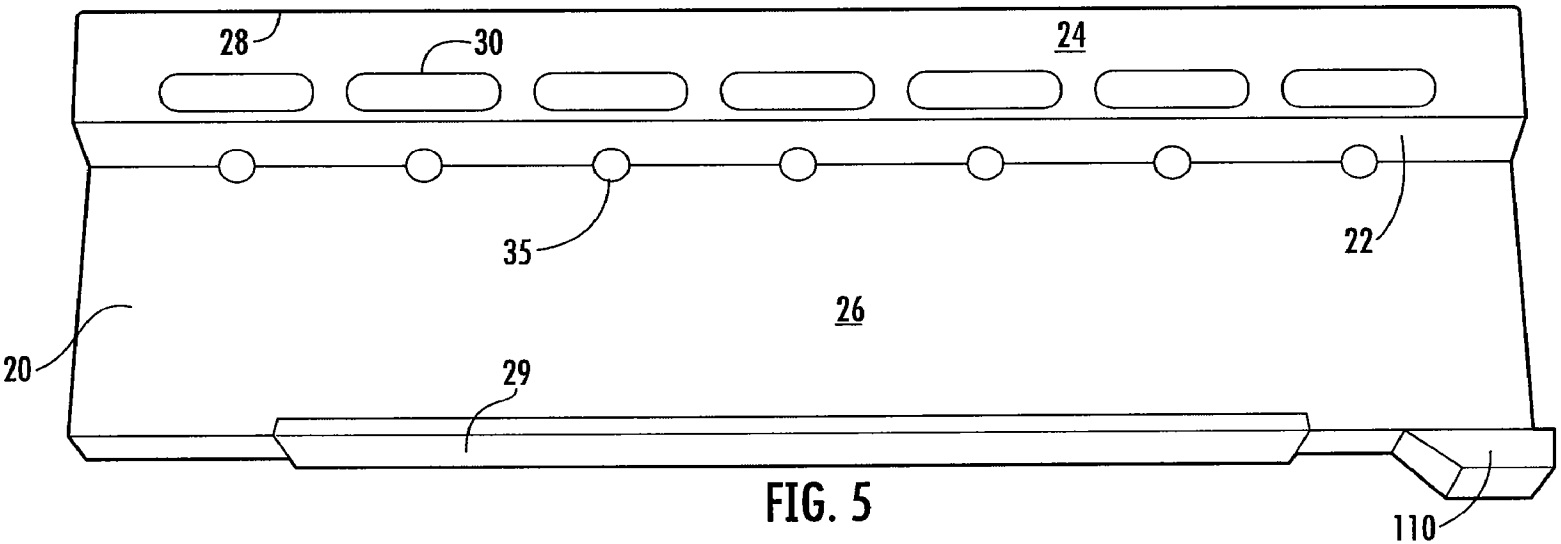
Figure 6:
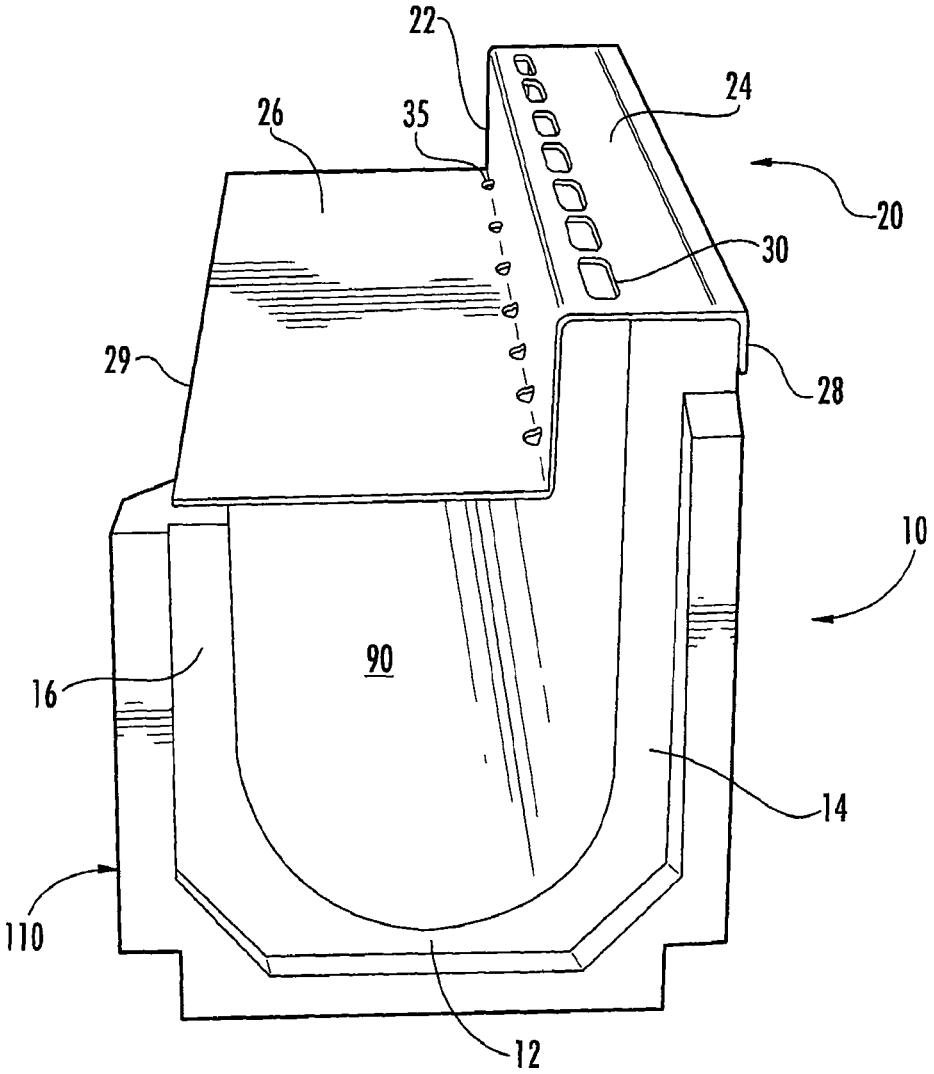

Having thus described embodiments of the invention in general terms, reference will now be made to the accompanying drawings, which are not necessarily draw to scale, and wherein:

FIG. 1 illustrates a side section view of a drainage system and synthetic turf edge in accordance with an embodiment of the present invention;

FIG. 2A illustrates a top view of a grate for covering a drainage channel in accordance with an embodiment of the present invention;

FIG. 2B illustrates a side view of a grate for covering a drainage channel in accordance with an embodiment of the present invention;

FIG. 3 illustrates a first perspective view of the drainage channel and grate of an embodiment of the present invention;

FIG. 4 illustrates a second perspective view of the drainage channel and grate of FIG. 3 in accordance with an embodiment of the present invention;

FIG. 5 illustrates a top view of the drainage channel and grate of FIG. 3 in accordance with an embodiment of the present invention; and FIG. 6 illustrates a side view of the drainage channel and grate of FIG. 3 in accordance with an embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a side section view of a drainage system 1 for draining water or other liquids from the surfaces on one or both sides of the drainage channel 10 in accordance with one embodiment of the invention. In one embodiment, the drainage system 1 is for use between a first surface corresponding to a first level and a second surface corresponding to a second level, where the first surface is vertically displaced from and elevated higher than the second surface. For example, as illustrated in FIG. 1, some embodiments of the invention provide for a transition from a first surface 70 to the synthetic turf surface 80 (or similar surface).

In the illustrated embodiment, the drainage system 1 comprises a drainage channel 10 set within concrete 50. The drainage channel 10 generally has a first sidewall 14, a second sidewall 16 spaced apart from the first sidewall 14, and a base portion 12 joining the lower portions of the two sidewalls to form a generally U-shaped channel 10. In one embodiment, the sidewalls 14 and 16 and the base portion 12 of the drainage channel 10 are integrally formed with each other. In other embodiments, however, the drainage channel 10 may be formed by coupling sidewalls 14 and 16 to the base portion 12 using fasteners. In some embodiments, the drainage channel 10 is comprised of one long integral channel. In other embodiments, however, the drainage channel 10 is comprised of a plurality of channel sections joined end to end.

The drainage channel 10 or sections thereof may be formed from cementitious materials such as concrete, polymeric materials, metallic materials, or other materials. In one embodiment, the drainage channel 10 is formed by pouring a cementitious material into a mold or form and letting the cementitious material cure in the mold or form. Such a molding process can occur on-site or at a remote location. Often the bottom interior surface of the drainage channel is sloped relative to the horizon so that water or other liquids received into the channel will drain toward a certain predetermined direction.

As illustrated in FIG. 1, the drainage system 1 comprises a grate 30 that extends across at least a portion of the opening 90 in the drainage channel 10. The grate 30 is structured so as to provide a transition from the first surface 70 to a synthetic turf surface 80. In some embodiments, mechanical fasteners, adhesives, and/or the like may be used to secure the synthetic turf 80 to the grate 30 and/or the grate 30 to the channel 10.

In the illustrated embodiment, the first surface 70 on one side of the drainage channel 10 comprises a track surface, such as a rubberized running track surface 74 supported by one or more track support layers 76 such as concrete, stone, etc. In other embodiments, however, the first surface 70 may comprise a cementitious surface, a masonry surface, a wood surface, a tile surface, or some other surface that may require draining of surface water or other liquids.

The synthetic turf surface 80 on the opposite side of the drainage channel 10 from the first surface 70 comprises a turf base portion 84 and a plurality of turf strands 82 extending therefrom. In one embodiment, the base portion 84 of the turf 80 comprises a turf mat 86 from which the turf strands 82 extend. The base portion 84 further comprises turf infill 88 placed over the turf mat 86 between the strands 82 and surrounding a lower portion of each strand 82. The infill 88 generally comprises sand, crumb rubber (e.g., small grains of rubber made from, in some embodiments, recycled tires), or a similarly suitable material or combination of materials. The infill 88 provides a soft forgiving surface that simulates the dirt surface in natural turf.

As illustrated in FIG. 1, the drainage system 1 is structured so that the top of the first surface 70 is generally in line with the top of the base portion 84 of the turf surface 80 (e.g., the turf mat 86 plus the turf infill 88). Furthermore, the drainage system 1 is structured to provide a synthetic turf support portion 26 of the grate 20 that provides a surface to which the edge of the synthetic turf mat 86 can be attached in order to secure and/or anchor the edge of the synthetic turf surface 80 in an easy and economical way.

As illustrated in FIG. 1, in one embodiment of the drainage system 1, the first sidewall 14 of the drainage channel 10 is taller than the second sidewall 16 of the drainage channel 10. In such an embodiment, the grate 20 comprises a first generally horizontal planar portion 24 extending from the upper edge of the first sidewall 14 partially over the opening 90 in the drainage channel 10. The grate 20 further comprises a second generally horizontal planar portion 26 extending from the upper edge of the second sidewall 16 at least partially over the opening 90 in the drainage channel 10. The first generally horizontal portion 14 of the grate 20 and the second generally horizontal portion 16 of the grate 20 are joined by a generally vertical transition portion 22 extending between the ends of the horizontal portions positioned over the opening 90 in the drainage channel 10.

As depicted in FIG. 1, the drainage system 1 is installed such that the first generally horizontal portion 24 of the grate 20 is approximately flush with the top of the first surface 70. In this way, surface water or other liquids can flow from the first surface 70 over the first generally horizontal portion 24 of the grate 20 and through grate openings 30 into the drainage channel 10. The second generally horizontal portion 26 of the grate 20 is vertically displaced from the first generally horizontal portion 24 of the grate 20 and is at a lower level than the first generally horizontal portion 24 such that, after the drainage system 1 is installed, the second generally horizontal portion 24 is approximately flush with the top of the turf support structure 95 that supports the turf surface 80 generally. The difference in height between the drainage channel's first sidewall 14 and second sidewall 16, as well as the length of the grate's generally vertical transition portion 30, is selected to be approximately equal to the height of the turf base 84 such that the grate's first generally horizontal portion 24 is approximately flush with the top of the turf base 84.

In one embodiment, the synthetic turf surface 80 is secured to the second generally horizontal portion 26 of the grate 20. Securing the synthetic turf 80 to the grate 20 helps secure and/or anchor at least a portion (e.g. the edge) of the synthetic turf surface 80 to prevent the surface 80 from sliding, being pulled up, and/or otherwise moving relative to the drainage system 1. The synthetic turf surface 80 may be secured using adhesives, including, for example, glue, epoxy, and/or the like. The surface 80 may also be alternatively or additionally secured using mechanical fasteners, including, for example, self-tapping self-drilling screws, nails, nuts and bolts, and/or the like.

FIGS. 2A and 2B provide a more detailed illustration of an exemplary grate 20 in accordance with an embodiment of the invention. FIGS. 3-6 illustrate various views of the drainage channel 10 and the accompanying grate 20 in accordance with an embodiment of the invention. As illustrated in the figures, in one embodiment the grate 20 is formed by bending a sheet of metal, such as steel, into the desired shape. For example, in one embodiment, the grate 20 is made from 14-gauge steel. In other embodiments however, other gauges of steel, other materials, and/or other manufacturing processes may be used to form the grate 20, as will be apparent to one of ordinary skill in the art in view of this disclosure.

The grate 20 may further comprise a first lip 28 extending downward from the first grate portion 24 and a second lip 29 extending downward from the second grate portion 26, so that the first lip 28 and second lip 29 are disposed adjacent to corresponding sidewalls 14, 16 of the drainage channel 10 to secure and/or hold the grate 20 in position relative to the drainage channel 10. Although not shown, it will be understood that, according to one embodiment, the first lip 28 and/or second lip 29 may be alternatively or additionally disposed adjacent to the inside portions of the sidewalls 14 and 16 of the drainage channel 10. Further, the grate 20 is often relatively heavy and, as such, in some embodiments and applications, the grate 20 is held in place over the drainage channel 10 solely by gravity. In other embodiments, however, the grate 20 is secured to drainage channel 10, such as by glue, screws, and/or other fasteners that secure the grate's first and second generally horizontal portions 24 and 26 to the tops of the first and second sidewalls 14 and 16, respectively, and/or the first and second lip portions 28 and 29 to the outside surface of first and second sidewalls 14 and 16, respectively.

In one embodiment, such as illustrated in FIG. 1, concrete 50 is poured around the top edge of the drainage channel 10 and encases the lips 28 and 29 or other structures extending from the grate 20 in the concrete to fix the grate 20 relative to the drainage channel 10.

As illustrated in FIGS. 2A, 2B, and 3, in some embodiments, second lip 29 (and/or in other embodiments, the first lip 28) is interrupted periodically along its length to provide space 100 for wider portions of the drainage channel 10 or for other structures, such as wider portion 110 used to join two adjacent channel sections end to end. In some embodiments, the grate 20 is used to straddle two adjacent channel sections and may be used to align the two sections during installation or to hold two or more channels in alignment. Although the figures provided herein illustrate only straight channels and rectangular grates, in other embodiments of the invention the drainage channel and grate are curved. For example, the drainage system used around an oval track may comprise curved channel sections and corresponding grates to match the curvature of the oval track.

As illustrated in FIGS. 2A and 2B, in one embodiment the grate 20 is provided in sections of approximately 40 inches long and 5.5 inches wide. In the illustrated embodiment, the first lip 28 is approximately 0.5 inches long, the first generally horizontal portion 24 is approximately 1.9 inches long, the generally vertical transition portion 22 is approximately 1.63 inches long, the second generally horizontal portion 26 is approximately 3.7 inches long, and the second lip 29 is approximately 0.5 inches long. In the illustrated embodiment, the space 90 between the first and second sidewalls of the drainage channel 10 is approximately 4.4 inches. In this embodiment, the height of the generally vertical transition portion 22 was selected based on the recommended height of the turf base 84 for one exemplary synthetic turf surface 80. These dimensions are provided to illustrate only one exemplary embodiment of the invention. Other embodiments of the invention have other dimensions, structures, and proportions based on the particular application and application-related factors.

As further illustrated in FIGS. 2A-2B and 3-6, the first generally horizontal portion 24 has drainage holes 30 therethrough so that surface water or other liquids running off of the surface of the first surface 70 can pass through the grate 20 and into the drainage channel 10. As illustrated, in one embodiment the drainage holes 30 comprise a plurality of oval-shaped openings approximately 0.5 inches wide and 2 inches long. Structuring the openings 30 so that they are 0.5 inches wide or narrower may be significant in some embodiments so that the grate 20 may be compliant with the Americans with Disabilities Act. In other embodiments, however, other shaped and sized openings are used to permit surface runoff from the first surface 70 to enter the drainage channel 10. Such openings 30 may be formed using a variety of techniques known in the art such as by drilling, punching, molding, cutting, and the like.

FIGS. 2A-2B and 3-6 also illustrate drainage holes 35 at the juncture between the grate's generally vertical transition portion 22 and the grate's second generally horizontal portion 26. In the illustrated embodiment, these holes 35 are generally circular and approximately 0.5 inches in diameter. In the illustrated embodiment the holes 35 are positioned and sized so as to provide drainage for water or other liquids that may seep through the turf mat 86. In such an embodiment, it is generally desirable that the holes 35 either be positioned entirely on the grate's second generally horizontal portion 26 or otherwise not extend higher than the thickness of the turf mat 86 so that significant amounts of turf infill 88 cannot pass through the holes 35 and enter the channel 10.

In some embodiments, the grate 20 does not have any such seepage holes 35 since the synthetic turf surface 80 may have its own independent drainage system. In other embodiments, the holes 35 are located entirely on the second generally horizontal portion 26 of the grate and/or are sized and shaped differently than those illustrated in the figures. For example, in one embodiment of the present invention where pebbles or small stones make up the surface represented in FIG. 1 by the synthetic turf surface 80 (e.g., where the drainage system forms an edge for a rock garden), then the holes 35 should be smaller than the majority of pebbles or stones used in the surface. The seepage holes 35 may be formed using a variety of techniques known in the art such as by drilling, punching, molding, cutting, and the like.

Referring again to FIG. 1, in some embodiments, where the drainage channel 10 is encased in concrete 50, the concrete may be structured to have a wide support base that tapers as the concrete 50 approaches the top of the drainage channel 10 or is structured to end at some location below the top of the drainage channel 10. In this way, first surface 70 may abut or come very close to abutting the edge of the grate 20, and the synthetic turf surface 80 can overlap the grate 20, providing a functional and aesthetically pleasing drainage system 1.

Although the figures provided herein generally illustrate an embodiment of the present invention where the drainage channel 10 has one sidewall taller than the other sidewall, in another embodiment the sidewalls are the same height as each other and, instead, the grate has opposing sidewalls attached to it that extend between the top edges of the channels sidewalls to the ends of the first and second generally horizontal sections of the grate. In this regard, the grate would comprise a first sidewall extending downward from the first generally horizontal member and this first grate sidewall would be taller than a second grate sidewall extending downward from the second generally horizontal member.

Furthermore, although embodiments of the invention are described above with regard to using the drainage system 1 as an edge device for a synthetic turf surface 80, in other embodiments drainage system's having the same or a similar structure as the embodiments described above can be used with other surfaces such as a natural turf surface, brick, stone or masonry surfaces, and the like. It should be appreciated that embodiments of the system described herein can be used in a number of different applications where drainage is required and where a surface transitions between a first generally flat surface (where drainage of surface runoff is desired) and a second surface that requires an edge, an anchor surface, drainage of seepage water, and/or has a thick top layer the bottom of which should be sunken relative to the top of the first surface so that the top of the second surface or some other portion thereof is flush with the first surface. For example, embodiments of the drainage system 1 described herein may be used where the second surface comprises loose stone, brick, tile, pavers, natural turf, and the like. As described above, embodiments of the invention can be used between a track and an infield. However, embodiments of the invention may also be used around synthetic turf on a roof deck of a building, between turf or a rock garden and a walkway, driveway, roadway or other surface, between a masonry surface and some other surface, around a football field, around real or synthetic planters indoors or outdoors, between pool decks and real or synthetic turf or rock gardens, etc. The type of application may dictate how long the generally vertical transition portion 22 needs to be and the difference between the heights of the channels sidewalls 14 and 16.

For example, where the drainage system 1 is used to provide an edge for a brick surface, the generally vertical transition portion 22 and difference in height in the channels sidewalls 14 and 16 may be sized to approximately equal the height of a brick or the brick plus some sub-surface layer height such as a gravel or sand layer.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A drainage apparatus for providing a transition from a first surface to a second surface, the apparatus comprising:

a drainage channel positioned between the first surface and the second surface, wherein the first surface and the second surface are separate from the drainage channel; and a grate for covering said drainage channel, said grate having one or more openings structured to allow a liquid to pass therethrough and into said drainage channel, wherein said grate comprises a first horizontally planar portion and a second horizontally planar portion and a generally vertical third portion extending between said first horizontally planar portion and said second horizontally planar portion, said grate being structured so that said first horizontally planar portion of said grate is positioned at a first level substantially flush with the first surface, and so that said second horizontally planar portion of said grate is positioned at a second level substantially flush with the second surface, and wherein said second level is displaced vertically from and lower than said first level.

2. The apparatus of claim 1, wherein said drainage channel comprises first and second sidewalls, wherein said grate comprises a first lip extending downward from said first horizontally planar portion of said grate, said first lip being disposed adjacent to at least a portion of said first sidewall of said drainage channel, wherein said grate further comprises a second lip extending downward from said second horizontally planar portion of said grate, said second lip being disposed adjacent to at least a portion of said second sidewall of said drainage channel.

3. The apparatus of claim 1, wherein at least a portion of said grate is secured to a portion of said drainage channel.

4. The apparatus of claim 1, wherein at least a portion of said grate is secured to at least a portion of the second surface.

5. The apparatus of claim 1, wherein said first horizontally planar portion of said grate further comprises one or more openings therethrough structured to allow a liquid flowing from the first surface to pass therethrough.

6. The apparatus of claim 1, wherein said second horizontally planar portion of said grate further comprises one or more openings therethrough structured to allow a liquid flowing from the second surface to pass therethrough.

7. The apparatus of claim 1, wherein a juncture between said second horizontally planar portion and said third portion comprises one or more openings therethrough structured to allow a liquid flowing from the second surface to pass therethrough.

8. The apparatus of claim 1, wherein said drainage channel comprises first and second sidewalls separated by an opening, wherein the length of said first sidewall is greater than the length of said second sidewall, and wherein said first sidewall is structured to support said first horizontally planar portion of said grate and said second sidewall is structured to support said second horizontally planar portion of said grate.

9. A drainage apparatus, the apparatus comprising:

a drainage channel comprising a first sidewall and a second sidewall separated by an opening and connected by a base extending the length of the opening, wherein the length of said first sidewall is greater than the length of said second sidewall; and a grate structured to extend across said drainage channel from said first sidewall to said second sidewall, said grate comprising:

a first horizontally planar portion extending from said first sidewall over at least a portion of said opening between said first sidewall and said second sidewall;

a second horizontally planar portion extending from said second sidewall over at least a portion of said opening between said first sidewall and said second sidewall; and a substantially vertical third portion extending between said first and second portions over at least a portion of said opening between said first sidewall and said second sidewall.

10. The apparatus of claim 9, wherein said grate comprises a first lip extending downward from said first horizontally planar portion of said grate, said first lip being disposed adjacent to at least a portion of said first sidewall of said drainage channel, wherein said grate further comprises a second lip extending downward from said second horizontally planar portion of said grate, said second lip being disposed adjacent to at least a portion of said second sidewall of said drainage channel.

11. The apparatus of claim 9, wherein at least one of a portion of said grate is secured to a portion of said drainage channel.

12. The apparatus of claim 9, wherein said first horizontally planar portion of said grate further comprises one or more openings therethrough structured to allow a liquid to flow therethrough.

13. The apparatus of claim 9, wherein said second horizontally planar portion of said grate further comprises one or more openings therethrough structured to allow a liquid to flow therethrough.

14. The apparatus of claim 9, wherein a juncture between said second horizontally planar portion of said grate and said third portion of said grate comprises one or more openings therethrough structured to allow a liquid to flow therethrough.

15. A drainage grate for covering an opening in a drainage channel, the drainage gate comprising:

a first horizontally planar portion having a first end and a second end; a second horizontally planar portion having a first end and a second end; and a generally vertical third portion extending from said second end of said first portion to said first end of said second portion, wherein said grate is structured so that, when said grate is installed over the opening in the drainage channel, said first end of said first portion of said grate is perpendicular to one side of the drainage channel and said second end of said second portion of said grate is perpendicular to a second side of the drainage channel, and wherein said first horizontally planar portion of said grate is structured to be offset vertically from and elevated higher than said second horizontally planar portion of said grate when said grate is installed over the opening in the drainage channel.

16. A method for installing a drainage apparatus between two vertically displaced surfaces, the method comprising:

providing a drainage channel;

providing a grate structured to extend across the drainage channel, wherein the grate comprises a first horizontally planar portion located at a first level corresponding to a first vertically displaced surface that is separate from the drainage channel and the grate, a second horizontally planar portion located at a second level corresponding to a second vertically displaced surface that is separate from the drainage channel and the grate, and a third portion located generally vertically between the first and second horizontally planar portions, and wherein at least one of the first, second, and third portions defines at least one opening therein for permitting liquid to pass therethrough into the drainage channel;

placing the grate across the drainage channel; and placing synthetic turf on the first portion of the grate.

17. A drainage apparatus for providing a transition from a first surface to a second surface upon which a synthetic turf is positioned, the apparatus comprising:

a drainage channel positioned between the first surface and the second surface, wherein the first surface and second surface are each separate from the drainage channel, said drainage channel comprising a first sidewall and a second sidewall, said first sidewall extending to a first level approximately flush with the first surface, said second sidewall extending to a second level approximately flush with the second surface, wherein said second level is displaced vertically from and lower than said first level and wherein the drainage channel is structured to secure the edge of the synthetic turf to prevent the synthetic turf from moving relative to said drainage channel.

* * * * *